US011662129B2

(12) United States Patent
Junge et al.

(10) Patent No.: US 11,662,129 B2
(45) Date of Patent: May 30, 2023

(54) METHOD AND APPARATUS FOR MAKING CLEAR ICE

(71) Applicant: Haier US Appliance Solutions, Inc., Wilmington, DE (US)

(72) Inventors: Brent Alden Junge, Evansville, IN (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/518,021

(22) Filed: Nov. 3, 2021

(65) Prior Publication Data

US 2023/0138774 A1 May 4, 2023

(51) Int. Cl.

| | |
|---|---|
| ***F25C 1/18*** | (2006.01) |
| ***F25C 1/045*** | (2018.01) |
| ***F25C 1/25*** | (2018.01) |

(52) U.S. Cl.

CPC ..... *F25C 1/18* (2013.01); *F25C 1/045* (2013.01); *F25C 1/25* (2018.01); *F25C 2400/14* (2013.01)

(58) Field of Classification Search

CPC .... F25C 1/045; F25C 1/18; F25C 1/25; F25C 2400/14

See application file for complete search history.

(56) References Cited

U.S. PATENT DOCUMENTS 5,527,470 A * 6/1996 Suda ..... F25C 1/22 324/439
5,931,003 A * 8/1999 Newman ..... F25C 5/10 62/74
6,241,893 B1 6/2001 Levy
7,591,399 B2 9/2009 Boarman
9,719,711 B2 8/2017 Bortoletto
(Continued)

FOREIGN PATENT DOCUMENTS

EP 2816303 A2 12/2014
JP 2003151026 A 5/2003
(Continued)

OTHER PUBLICATIONS

English language translation JP 2003-151026, Nohara et al. (Year: 2003).*

*Primary Examiner* — Cassey D Bauer
(74) *Attorney, Agent, or Firm* — Dority & Manning, P.A.

(57) ABSTRACT

An icemaker appliance and a method for making clear ice are provided. The icemaking apparatus includes a cabinet forming an ice storage compartment. A reservoir is provided within the ice storage compartment. A liquid supply conduit is configured to supply liquid to the reservoir. An ice mold is configured to freeze liquid at the ice mold. A nozzle is configured to dispense the liquid from the reservoir to the ice mold. A controller is configured to execute instructions that perform operations. The operations include dispensing, from a body of liquid at the reservoir, a flow of liquid toward the ice mold; freezing, at the ice mold, a first portion of the flow of liquid received from dispensing the flow of liquid to the ice mold; providing, to the reservoir, a second portion of the flow of liquid dispensed toward the ice mold; and providing, from the liquid supply conduit to the reservoir, a supply of liquid after dispensing the flow of liquid toward the ice mold.

17 Claims, 7 Drawing Sheets

(56) References Cited

U.S. PATENT DOCUMENTS

| | | | |
|---|---|---|---|
| 10,274,238 | B2 | 4/2019 | Mitchell |
| 10,336,629 | B2 | 7/2019 | Mitchell |
| 10,378,806 | B2 | 8/2019 | Boarman |
| 10,823,475 | B2 | 11/2020 | Junge |
| 2012/0031114 | A1 | 2/2012 | Mueller |
| 2020/0318886 | A1 | 10/2020 | Almblad |

FOREIGN PATENT DOCUMENTS

| | | | | |
|---|---|---|---|---|
| JP | 2004347310 | * | 12/2004 | ..... F25C 1/18 |
| JP | 2006038262 | A | 2/2006 | |
| JP | 2006177600 | A | 7/2006 | |

* cited by examiner

METHOD AND APPARATUS FOR MAKING CLEAR ICE

FIELD

The present subject matter relates generally to clear ice makers, and more particularly to icemakers capable of drainless operation of making clear ice.

BACKGROUND

Icemaker appliances generally include an ice maker that is configured to generate ice. Ice makers within icemaker appliances are plumbed to a water supply, and water from the water supply may flow to the ice maker within the icemaker appliances. Icemaker appliances are frequently cooled by a sealed system, and heat transfer between liquid water in the ice maker and refrigerant of the sealed system generates ice.

In certain icemaker appliances, for instance, clear ice makers, water may be continually sprayed onto a chilled mold to form ice without dissolved solids which result in cloudy ice. Commonly, the icemaker appliances are plumbed to an external drain (e.g., connected to a municipal water system) to dispose of the excess water that is not frozen during an icemaking process (e.g., excess water containing dissolved solids). While effective for managing the excess water, external drain lines have drawbacks. For example, external drain lines can be expensive to install. In addition, external drain lines can be difficult to install in certain locations. Additionally, cleaning such icemaker appliances can be burdensome and time consuming.

Further, certain icemakers utilize potable municipal water in an icemaking process. This municipal water contains certain levels of Total Dissolved Solids (TDS). During some icemaking processes, only the water containing sufficiently low levels of TDS will freeze into clear ice cubes. The leftover water then contains a higher concentration of TDS, which is too high to form clear ice. Thus, leftover water remains within the icemaker, requiring removal by the user in order to continue the icemaking process.

Accordingly, an icemaker appliance with features for operating without an external drain line would be useful. In particular, an icemaker appliance that uses leftover water from a clear ice cycle would be useful.

BRIEF DESCRIPTION

Aspects and advantages of the invention will be set forth in part in the following description, or may be obvious from the description, or may be learned through practice of the invention.

In one exemplary aspect of the present disclosure, an icemaker appliance is provided. The icemaking apparatus includes a cabinet forming an ice storage compartment. A reservoir is provided within the ice storage compartment. A liquid supply conduit is configured to supply liquid to the reservoir. An ice mold is configured to freeze liquid at the ice mold. A nozzle is configured to dispense the liquid from the reservoir to the ice mold. A controller is configured to execute instructions that perform operations. The operations include dispensing, from a body of liquid at the reservoir, a flow of liquid toward the ice mold; freezing, at the ice mold, a first portion of the flow of liquid received from dispensing the flow of liquid to the ice mold; providing, to the reservoir, a second portion of the flow of liquid dispensed toward the ice mold; and providing, from the liquid supply conduit to the reservoir, a supply of liquid after dispensing the flow of liquid toward the ice mold.

Another aspect of the present disclosure is directed to a method for producing clear ice. The method includes dispensing, from a body of liquid at the reservoir, a flow of liquid toward the ice mold; freezing, at the ice mold, a first portion of the flow of liquid received from dispensing the flow of liquid to the ice mold; providing, to the reservoir, a second portion of the flow of liquid dispensed toward the ice mold; and providing, from the liquid supply conduit to the reservoir, a supply of liquid after dispensing the flow of liquid toward the ice mold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
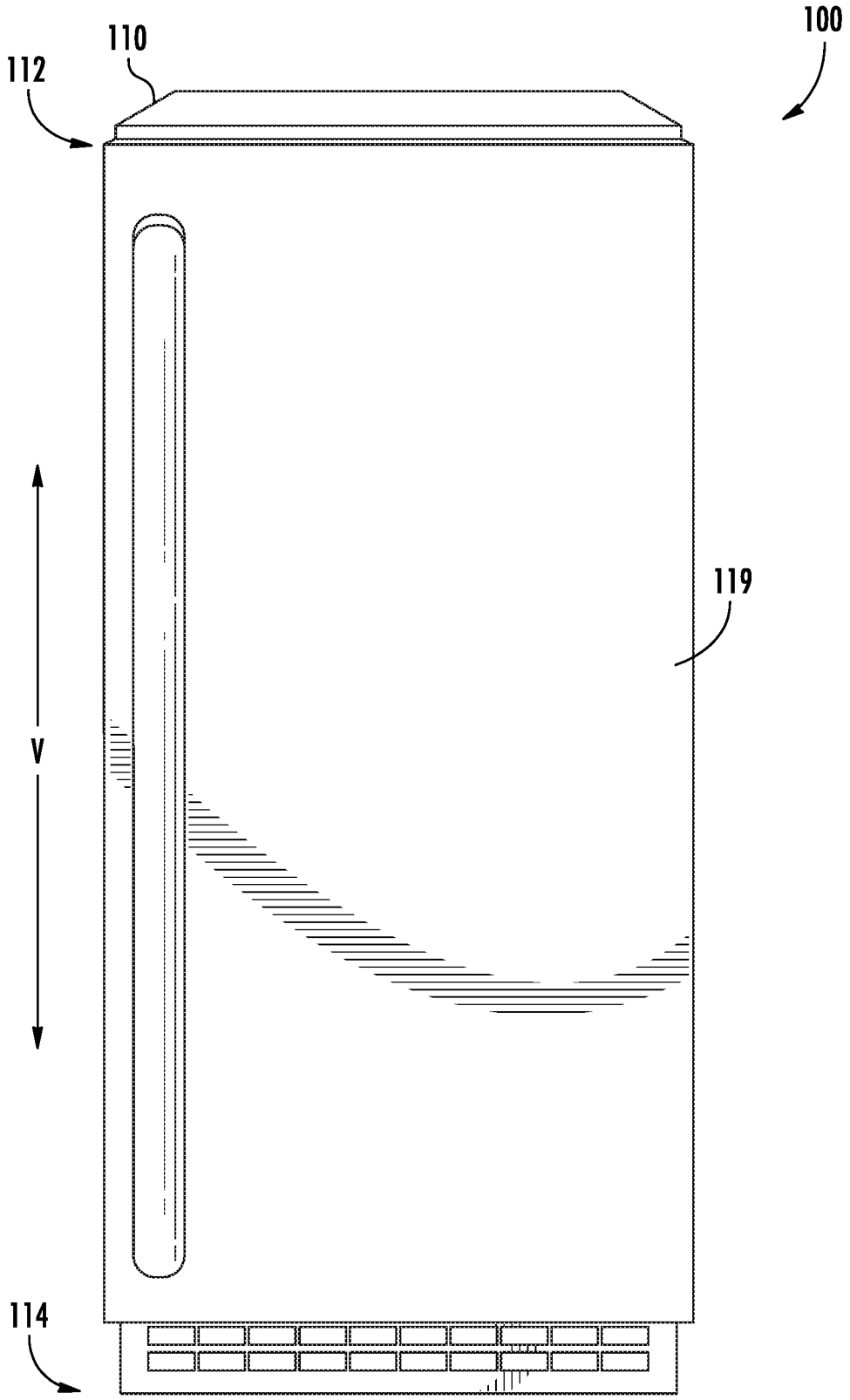
FIG. 1 provides a front, perspective view of an icemaker appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
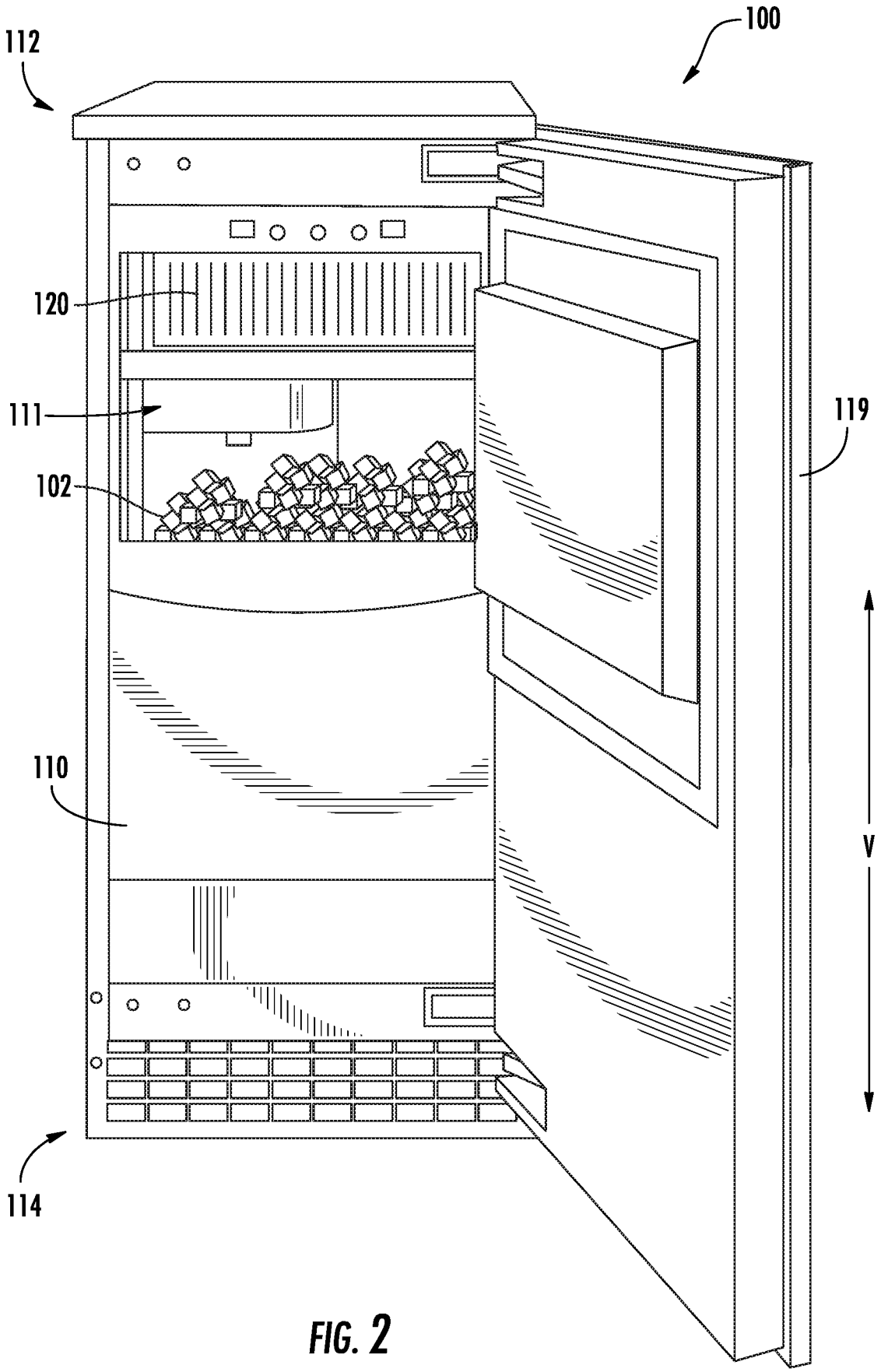
FIG. 2 provides a front, perspective view of the exemplary icemaker appliance of FIG. 1 with a door of the icemaker appliance shown in an open position.

Methods and apparatuses for generating clear ice are provided herein. Embodiments provided herein allows for making clear ice without requiring a drain plumbed to an icemaking apparatus. Embodiments provided herein may allow for recycling liquid and producing clear ice without draining liquid to a wastewater drain. Apparatuses and methods provided herein may be applied to clear ice makers at refrigerator appliances, standalone table-top icemaker appliances, or under-counter icemaker appliances. Apparatuses and methods provided herein may generally include providing water to an ice making mold FIGS. 1 and 2 provide front, perspective views of an icemaker appliance 100 according to an example embodiment of the present subject matter. As discussed in greater detail below, icemaker appliance 100 includes features for generating or producing clear ice. Thus, a user of icemaker appliance 100 may consume clear ice stored within icemaker appliance 100. As may be seen in FIG. 1, icemaker appliance 100 defines a vertical direction V.

Icemaker appliance 100 includes a cabinet 110. Cabinet 110 may be insulated in order to limit heat transfer between an interior volume 111 (FIG. 2) of cabinet 110 and ambient atmosphere. Cabinet 110 extends between a top portion 112 and a bottom portion 114, e.g., along the vertical direction V. Thus, top and bottom portions 112, 114 of cabinet 110 are spaced apart from each other, e.g., along the vertical direction V. A door 119 is mounted to cabinet 110 at a front portion of cabinet 110. Door 119 permits selective access to interior volume 111 of cabinet 110. For example, door 119 is shown in a closed position in FIG. 1, and door 119 is shown in an open position in FIG. 2. A user may rotate door between the open and closed positions to access interior volume 111 of cabinet 110.

As may be seen in FIG. 2, various components of icemaker appliance 100 are positioned within interior volume 111 of cabinet 110. In particular, icemaker appliance 100 includes an ice maker 120 disposed within interior volume 111 of cabinet 110, e.g., at top portion 112 of cabinet 110. Ice maker 120 is configured for producing clear ice. Ice maker 120 may be configured for making any suitable type of clear ice. Thus, e.g., ice maker 120 may be a clear cube ice maker, as would be understood.

Icemaker appliance 100 may also include an ice storage compartment or storage bin 102. Ice storage compartment 102 may be provided within interior volume 111 of cabinet 110. In particular, ice storage compartment 102 may be positioned, e.g., directly, below ice maker 120 along the vertical direction V. Thus, ice storage compartment 102 is positioned for receiving clear ice from ice maker 120 and is configured for storing the clear ice therein. It will be understood that ice storage compartment 102 may be maintained at a temperature greater than the freezing point of water. Thus, the clear ice within ice storage compartment 102 may melt over time while stored within ice storage compartment 102. Icemaker appliance 100 may include features for recirculating liquid meltwater from ice storage compartment 102 to ice maker 120.

Figure 3:
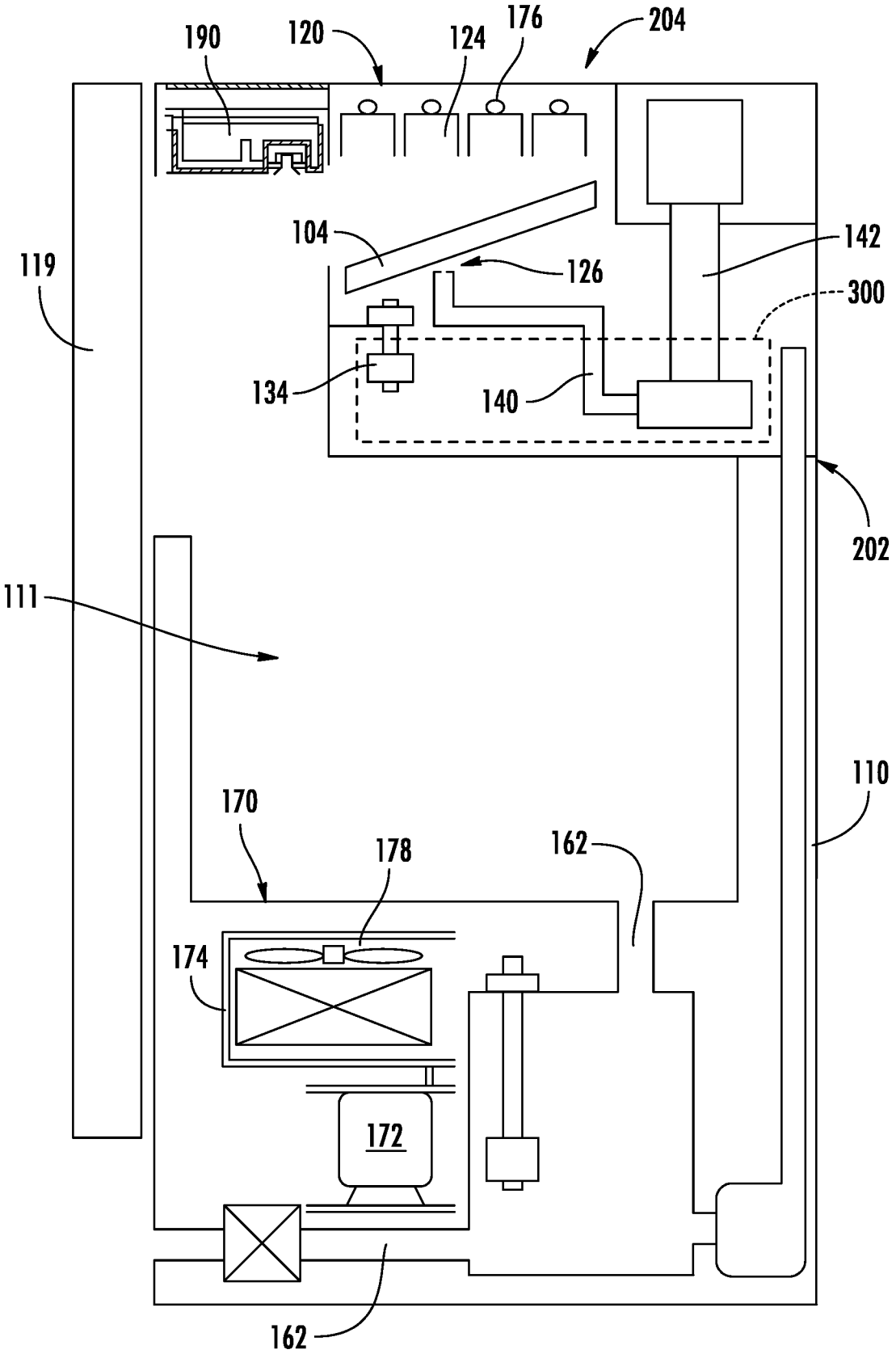
FIG. 3 provides a side, schematic view of certain components of the exemplary icemaker appliance of FIG. 1.

FIG. 3 provides a schematic view of certain components of icemaker appliance 100. As may be seen in FIG. 3, ice maker 120 may include an ice mold 124 and a nozzle 126. For instance, ice mold 124 may include a plurality of ice molds for forming a plurality of ice cubes at one time. Liquid from nozzle 126 may be dispensed toward ice mold 124. For example, nozzle 126 may be provided below ice mold 124 within a first reservoir 128 and may dispense liquid water upward toward ice mold 124. As discussed in greater detail below, ice mold 124 is cooled by refrigerant. Thus, the liquid water from nozzle 126 flowing across ice mold 124 may freeze on ice mold 124, e.g., in order to form clear ice cubes on ice mold 124. Further, as described below, ice mold 124 may include a plurality of first ice molds 1241 and a plurality of second ice molds 1242.

To cool ice mold 124, icemaker assembly 100 includes a sealed system 170. Sealed system 170 includes components for executing a known vapor compression cycle for cooling ice maker 120 and/or air. The components include a compressor 172, a condenser 174, an expansion device (not shown), and an evaporator 176 connected in series and charged with a refrigerant. As will be understood by those skilled in the art, sealed system 170 may include additional components, e.g., at least one additional evaporator, compressor, expansion device, and/or condenser. Additionally or alternatively, the placement of the components (e.g., compressor 172, condenser 174, etc.) may be adjusted according to specific embodiments. Thus, sealed system 170 is provided by way of example only. It is within the scope of the present subject matter for other configurations of a sealed system to be used as well.

Within sealed system 170, refrigerant flows into compressor 172, which operates to increase the pressure of the refrigerant. This compression of the refrigerant raises its temperature, which is lowered by passing the refrigerant through condenser 174. Within condenser 174, heat exchange with ambient air takes place so as to cool the refrigerant. A fan 178 may operate to pull air across condenser 174 so as to provide forced convection for a more rapid and efficient heat exchange between the refrigerant within condenser 174 and the ambient air.

The expansion device (e.g., a valve, capillary tube, or other restriction device) receives refrigerant from condenser 174. From the expansion device, the refrigerant enters evaporator 176. Upon exiting the expansion device and entering evaporator 176, the refrigerant drops in pressure. Due to the pressure drop and/or phase change of the refrigerant, evaporator 176 is cool, e.g., relative to ambient air and/or liquid water. Evaporator 176 is positioned at and in thermal contact with ice maker 120, e.g., at ice mold 124 of ice maker 120. Thus, ice maker 120 may be directly cooled with refrigerant at evaporator 176.

It should be understood that ice maker 120 may be an air-cooled ice maker in alternative example embodiments. Thus, e.g., cooled air from evaporator 176 may refrigerate various components of icemaker appliance 100, such as ice mold 124 of ice maker 120. In such example embodiments, evaporator 176 is a type of heat exchanger which transfers heat from air passing over evaporator 176 to refrigerant flowing through evaporator 176, and fan may circulate chilled air from the evaporator 176 to ice maker 120.

In some embodiments, icemaker appliance 100 may further include a cleanout line 162. Cleanout line 162 may include an additional reservoir (e.g., a third reservoir) which may collect meltwater from ice storage compartment 102. In one example, cleanout line 162 is connected directly to ice storage compartment 102. Accordingly, liquid within ice storage compartment 102 may flow out of ice storage compartment 102 through cleanout line 162. A second end of cleanout line 162 may be exposed outside of icemaker appliance 100. Liquid flowing through cleanout line 162 may be released from icemaking appliance 100 via the second end. In other embodiments, liquid flowing through cleanout line 162 may be resupplied to first reservoir 128. In still other embodiments, cleanout line 162 may be omitted entirely, such that icemaker appliance 100 is drainless.

Icemaker appliance 100 may also include a controller 190 that regulates or operates various components of icemaker appliance 100. Controller 190 may include a memory and one or more microprocessors, CPUs or the like, such as general or special purpose microprocessors operable to execute programming instructions or micro-control code associated with operation of icemaker appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Input/output ("I/O") signals may be routed between controller 190 and various operational components of icemaker appliance 100. As an example, the various operational components of icemaker appliance 100 may be in communication with controller 190 via one or more signal lines or shared communication busses.

The ice maker 102 may further include a heater (not shown) provided at or near ice mold 124. During a harvesting of the ice cubes formed on ice mold 124, the heater may be activated to heat ice mold 124 and subsequently release the ice cubes from ice mold 124. In one embodiment, the sealed system 170 may be turned off (i.e., no refrigerant is supplied to evaporator 176) and the heater may be turned on for a predetermined amount of time. Ice mold 124 is then temporarily heated by the heater to release or harvest the ice cubes. The heater may be an electric heater, for example. However, it should be understood that various types of heaters may be used to heat ice mold 124, including a reverse flow of refrigerant or a hot gas bypass through sealed system 170, for another example, and the disclosure is not limited to those examples provided herein.

Figure 4:
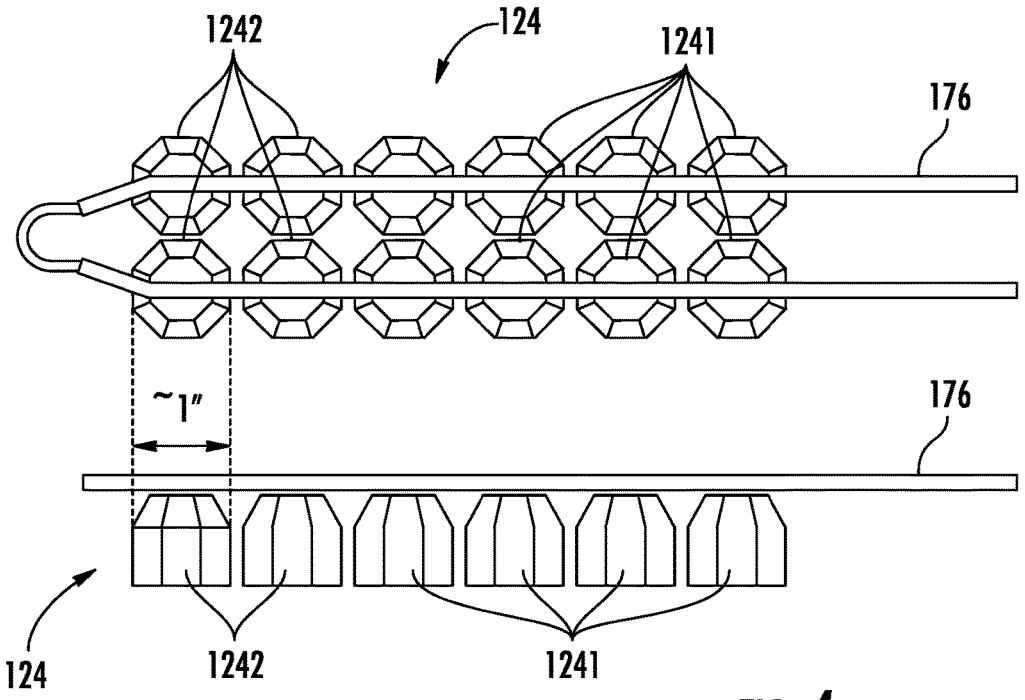
FIG. 4 provides top and side schematic views of a plurality of ice molds according to the exemplary icemaker appliance of FIG. 1.
Figure 5:
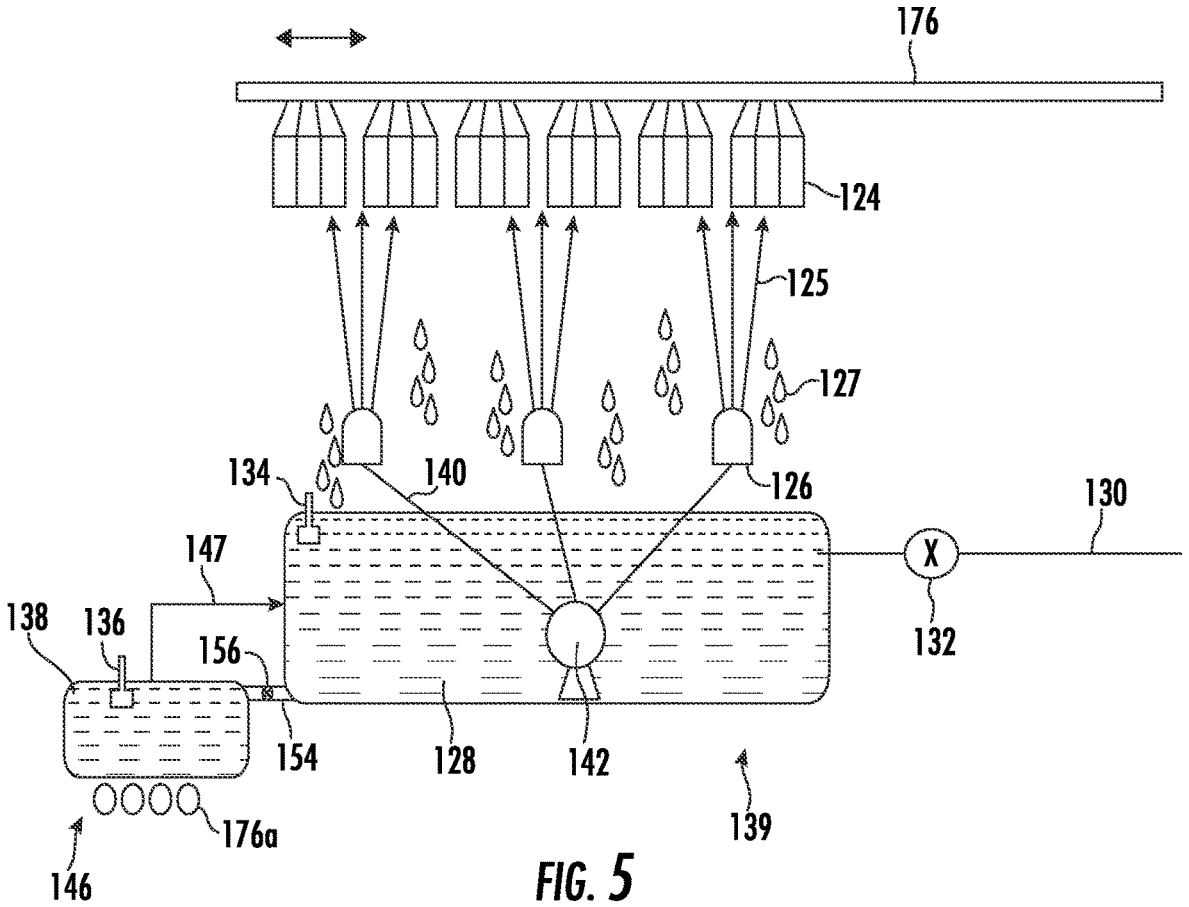
FIG. 5 provides a side schematic view of a plurality of ice molds and first and second reservoirs according to the exemplary icemaker appliance of FIG. 1.

FIG. 4 provides top and side schematic views of ice maker 120, and FIG. 5 provides a side schematic view of ice maker 120 including ice molds 124, as well as first reservoir 128 and second reservoir 138. For example, first reservoir 128 and second reservoir 138 may be located within inset 300 of FIG. 3. Referring to FIG. 4, ice maker 120 may include ice molds 124. Additionally or alternatively, evaporator 176 may be attached to ice molds 124. Ice molds 124 may include the plurality of first ice molds 1241 and the plurality of second ice molds 1242. The plurality of first ice molds 1241 may be distinguished from the plurality of second ice molds 1242 along the transverse direction T, in one example. For instance, the plurality of first ice molds 1241 may be located proximate a rear of cabinet 110 and the plurality of second ice molds 1242 may be located proximate a front of cabinet 110. It should be noted that the locations of the plurality of first ice molds 1241 and the plurality of second ice molds 1242 are provided by way of example only, and that the locations thereof may be altered according to specific embodiments.

Icemaker appliance 100 may include a liquid supply conduit 130 and a supply valve 132. Liquid supply conduit 130 is connectable to an external pressurized liquid supply, such as a municipal water supply or well. Supply valve 132 may be coupled to liquid supply conduit 130, and supply valve 132 may be operable (e.g., openable and closable) to regulate liquid water flow through liquid supply conduit 130 into icemaker appliance 100. In one embodiment, liquid supply conduit 130 is connected to first reservoir 128. In detail, liquid supply conduit 130 is in fluid communication with first reservoir 128 to allow external water to be supplied into first reservoir 128 via liquid supply conduit 130. Thus, e.g., first reservoir 128 may be filled with fresh liquid water from the external pressurized water supply through liquid supply conduit 130 by opening supply valve 132. Liquid supply conduit 130 may be connected at a bottom of cabinet 110. In some embodiments, liquid supply conduit 130 is connected at a top of cabinet 110. According to this embodiment, water introduced through a top of the cabinet may be released over top of ice maker 120 and may assist in a harvesting operation of ice formed on ice mold 124.

Referring now to FIG. 5, icemaker appliance 100 may include first reservoir 128. First reservoir 128 may be provided within ice storage compartment 102. For example, first reservoir 128 may be located at or near top portion 112 of interior volume 111 of ice storage compartment 102. First reservoir 128 may define a receiving space that holds liquid (e.g., water) to be formed into ice. For example, an inner volume of first reservoir 128 may be smaller than interior volume 111 of ice storage compartment 102. In some embodiments, first reservoir 128 may hold other liquids, such as cleaning solutions, for example.

Ice maker 120 may be provided within first reservoir 128. In detail, evaporator 176 and ice mold 124 may be located within first reservoir 128. In some embodiments, ice maker 120 is provided above first reservoir 128 (e.g., along the vertical direction V). First reservoir 128 may extend along the vertical direction V from a bottom end 202 to a top end 204. Ice maker 120 may be mounted at the top end 204 of the first reservoir 128. For example, evaporator 176 may be mounted to the top end 204 and ice mold 124 may be connected to evaporator 176. In some embodiments, ice mold 124 may be defined by evaporator 176. In other words, evaporator 176 is integral with ice mold 124 such that the clear ice is formed directly on evaporator 176.

Icemaker appliance 100 may include a first circulation system 139. First circulation system 139 may include a first pump 142, a first circulation conduit 140, and a first nozzle 126. First pump 142 may be provided within first reservoir 128. First pump 142 may pump water or liquid stored in first reservoir 128. First circulation conduit 140 may be connected to first pump 142 such that the water or liquid pumped by first pump 142 is circulated through first circulation conduit 140. First circulation conduit 140 may include a series of tubes or pipes capable of guiding the water or liquid pumped by first pump 142. First nozzle 126 may be provided at a downstream end of first circulation conduit 140. First nozzle 126 may dispense the water or liquid stored in first reservoir 128 toward ice maker 120 (i.e., ice mold 124 and/or evaporator 176).

In one embodiment, first nozzle 126 may be located near bottom end 202 of first reservoir 128. As such, the water or liquid may be sprayed in a generally upward direction from first nozzle 126 toward ice maker 120. Accordingly, clear ice may be formed on ice maker 120 due to a constant spray of water onto ice maker 120 while ice maker is cooled by a circulation of refrigerant through sealed system 170. In detail, liquid dispensed from first nozzle 126 may be directed toward the ice mold 124, such as depicted in FIG. 5. In other embodiments, the first nozzle 126 may direct the liquid to the plurality of first ice molds 1241. In some embodiments, a plurality of first nozzles 126 may be provided. Each of the plurality of first nozzles 126 may be connected to first pump 142 independently (e.g., each first nozzle 126 having a dedicated first circulation conduit 140). Additionally or alternatively, each of the plurality of first nozzles 126 may be connected to the first pump 142 via a joint circulation conduit.

Icemaker appliance 100 may also be operated in a cleaning mode, or may perform a cleaning operation to clean the various pieces in icemaker appliance 100 that may become contaminated with foreign debris. For example, in some embodiments, cleaning solution or acid may be pumped through first circulation conduit 140 and dispensed by nozzle 126 toward ice maker 120. Accordingly, the cleaning solution or acid may remove the foreign contaminants or debris from, for example, ice mold 124, nozzle 126, first reservoir 128, and first circulation conduit 140.

A first liquid level sensor or switch 134 may be provided in first reservoir 128. Generally, the first liquid level sensor 134 may sense a level of liquid contained within first reservoir 128. In some embodiments, first liquid level sensor 134 is in operable communication with controller 190. For instance, first liquid level sensor 134 may communicate with the controller 190 via one or more signals. In certain embodiments, first liquid level sensor 134 includes a predetermined threshold level (e.g., to indicate the need for additional liquid to first reservoir 128). In particular, first liquid level sensor 134 may detect if or when the liquid first reservoir 128 is below the predetermined threshold level. Optionally, first liquid level sensor 134 may be a two-position sensor. In other words, first liquid level sensor 134 may either be "on" or "off," depending on a level of liquid.

For example, when the liquid level is below the predetermined threshold level, first liquid level sensor 134 is "off," meaning it does not send a signal to first pump 142 via controller 190 to pump liquid from first reservoir 128 through first circulation conduit 140 toward first nozzle 126. For another example, when the liquid level is above the predetermined threshold, first liquid level sensor 134 is "on," meaning it sends a signal to first pump 142 via controller 190 to operate first pump 142 to pump liquid through first circulation conduit 140 toward first nozzle 126. It should be understood that first liquid level sensor 134 may be any suitable sensor capable of determining a level of liquid within first reservoir 128, and the disclosure is not limited to those examples provided herein.

In some embodiments, a filter (not shown) may be connected to first circulation conduit 140. The filter may filter out solid contaminants from water in the first reservoir 128. The filter may be provided downstream from first pump 142. Additionally or alternatively, the filter may be provided upstream from nozzle 126. In some such embodiments, the filter is provided along a flow path between first pump 142 and nozzle 126, such that water passes from first reservoir 142 through the filter before being dispensed by nozzle 126. The filter may include a filter medium which performs the actual filtration. For example, the filter medium may be a deionization filter. Nonetheless, it should be understood that various additional or alternative suitable filter mediums or devices may be incorporated as the filter medium, or the filter may be omitted entirely.

Referring briefly to FIG. 5, certain embodiments of icemaker appliance 100 may include a second reservoir 138. Second reservoir 138 may be provided within ice storage compartment 102. For example, second reservoir 138 may be immediately adjacent to first reservoir 128. Second reservoir 138 may define a receiving space that holds liquid of a higher total dissolved solids (TDS) relative to the body of liquid at the first reservoir 128. For example, an inner volume of second reservoir 138 may be smaller than interior volume 111 of ice storage compartment 102. Second reservoir 138 may be in fluid communication with first reservoir 128. For instance, liquid contained within first reservoir 128 may be selectively diverted to second reservoir 138 via second conduit 147, such as described further herein. Second reservoir 138 may be lower than first reservoir 128 (e.g., along the vertical direction V). In detail, a bottom of second reservoir 138 may be lower than a bottom of first reservoir 128 along the vertical direction V. Additionally or alternatively, a top of second reservoir 138 may be lower than a top of first reservoir 128 (e.g., along the vertical direction).

First reservoir 128 and second reservoir 138 may be connected by a conduit 154. Conduit 154 may include a pipe, duct, or conduit allowing liquid to flow from first reservoir 128 into second reservoir 138. Conduit 154 may be any suitable length, and the disclosure is not limited in size or material used. Additionally, or alternatively, a valve 156 may be provided on conduit 154. For instance, the valve 156 at the conduit 154 may allow selectively opening and closing of fluid between the first reservoir 128 and second reservoir 138. Valve 156 may receive input signals from controller 190 to selectively open and close to allow liquid from first reservoir 128 to pass through valve assembly 156 into second reservoir 138, such as described further herein. In various embodiments, valve 156 may be any suitable type of valve, such as a check valve, a gate valve, a flap valve, a ball valve, an electronic valve, or the like. In some embodiments, the valve is a mechanical valve (i.e., valve may open and close according to a liquid pressure from first reservoir 128, without electronic intervention from controller 190).

In detail, icemaker appliance 100 may receive a level of liquid (e.g., municipal water) into first reservoir 128 provided from liquid supply conduit 130. Icemaker appliance 100 may then perform a plurality of icemaking cycles or operations each forming clear ice. The leftover liquid remaining within first reservoir 128 may contain levels of total dissolved solids (TDS) higher than a level of TDS of the liquid provided from the liquid supply conduit 130 to the first reservoir 128.

Accordingly, controller 190 may open valve 156 to allow the liquid in first reservoir 128 to flow into second reservoir 138 when a threshold TDS level is exceeded. In various embodiments, the liquid in first reservoir 128 is selectively transferred to second reservoir 138 according to a detected level of TDS, such as described in further detail below.

Figure 7:
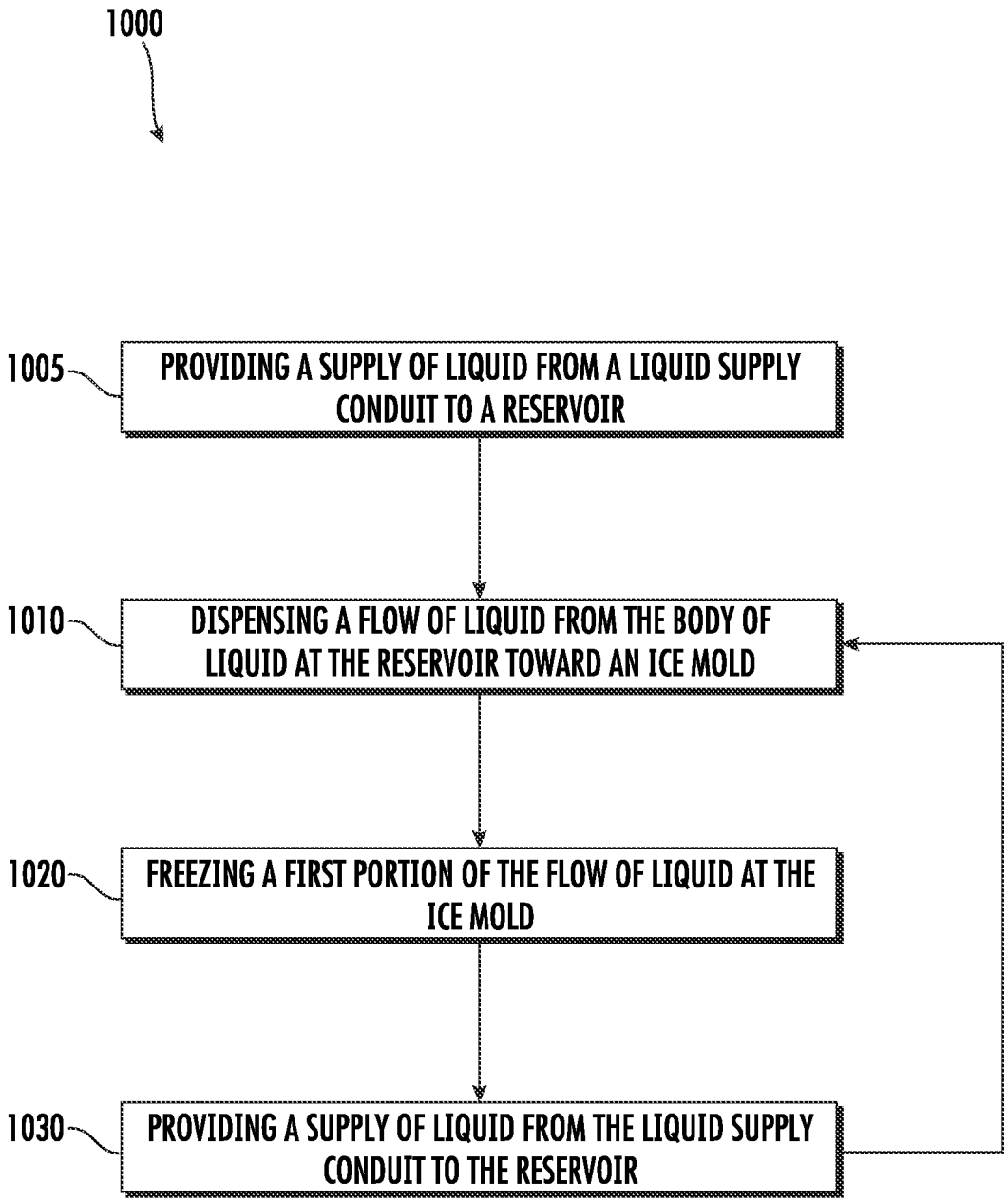
FIG. 7 provides a flowchart outlining steps of a method for making clear ice according to an exemplary embodiment of the present subject matter.
Figure 8:
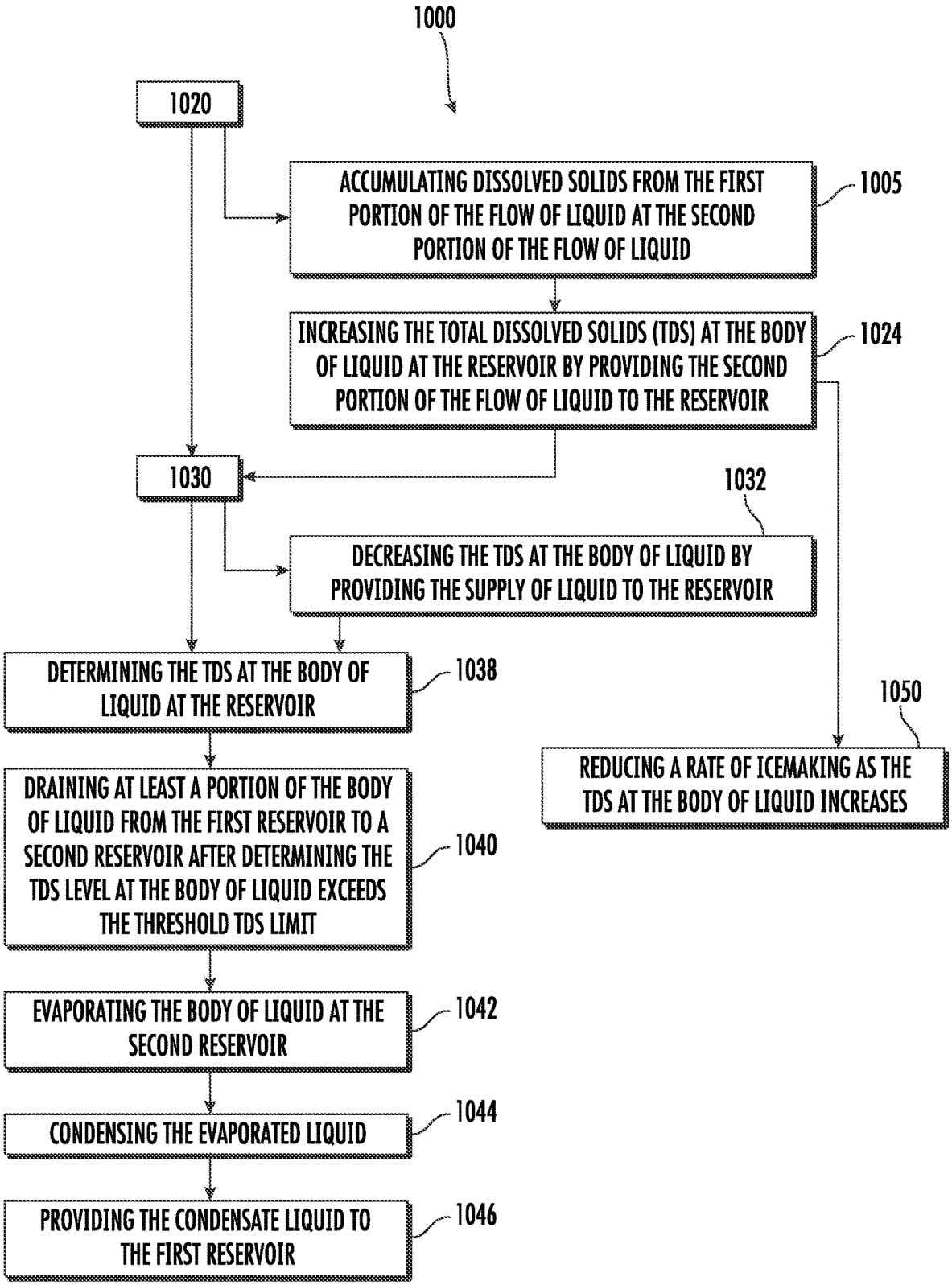
FIG. 8 provides a flowchart outlining steps of a method for making clear ice according to an exemplary embodiment of the present subject matter.

Embodiments of the icemaker appliance 10 are configured to perform or execute steps of a method for producing ice (hereinafter "method 1000"), such as outlined in flowcharts in FIGS. 7-8. Icemaking appliances, such as embodiments of the icemaker appliance 10 provided in regard to FIGS. 1-6, may be configured to store or receive instructions and execute operations in accordance with steps of embodiments of the method 1000. Instructions stored by the controller 190, when executed, cause the icemaker appliance 10 to perform operations for producing ice. In particular, methods, or operations executed by the controller 190, generate clear ice, such as having substantially less total dissolved solids (TDS) than ice formed from water as substantially received from a liquid supply conduit 130. Embodiments of the method 1000 allow for producing ice having substantially zero total dissolved solids, generating clear ice substantially free of matter that may generate cloudiness in the ice.

Steps of the operations or method 1000 include at 1005 providing a supply of liquid (e.g., water) from a liquid supply conduit (e.g., liquid supply conduit 130) to a reservoir (e.g., reservoir 128). The liquid provided from the liquid supply conduit generally has a baseline level of total dissolved solids (TDS), such as may be received from a water source, or after one or more filters at the appliance or facility at which the appliance is utilized. An initial body of liquid provided to the reservoir has TDS levels substantially similar to the baseline level TDS of the supply of liquid from the liquid supply conduit. For example, the baseline TDS of the supply of liquid from the liquid supply conduit may be approximately 100 parts per million (ppm). However, it should be appreciated that the baseline TDS may be any level below a threshold level of TDS such as described further herein.

The method 1000 includes at 1010 dispensing a flow of liquid from the body of liquid at the reservoir toward an ice mold (e.g., ice mold 124). In particular, step 1010 may include dispensing or spraying the flow of liquid through a nozzle (e.g., nozzle 126) toward the ice mold. The method 1000 includes at 1020 freezing a first portion of the flow of liquid at the ice mold received from 1010. The method 1000 includes at 1030 providing a second portion of the flow of liquid dispensed via step 1010 to the reservoir (e.g., reservoir 128). In various embodiments, the first portion of the flow of liquid frozen at the ice mold is approximately 10% or less of the flow of liquid dispensed toward the ice mold, and the second portion of the flow of liquid is a remainder or difference (e.g., 90% or more) of the flow of liquid dispensed toward the ice mold. As such, a proportion of the first portion of the flow of liquid to the second portion is approximately 10/90 or less. In certain embodiments, the proportion of first portion to second portion is approximately 5/95 or less, or particularly approximately 1/99. The unfrozen portion of the flow of liquid dispensed from the nozzle (i.e., the second portion) is provided, such as via gravity, drip, or catchment of the reservoir (e.g., reservoir 128). The method 1000 may form an icemaking cycle iteratively performing steps 1010 and 1020 until clear ice is formed at the ice mold (e.g., ice mold 124).

The first portion of the flow of liquid that is frozen at the ice mold 124 has a first level of TDS less than the second portion that is provided back to the reservoir 128. The first level of TDS may change as the icemaking cycle continues, or as further icemaking cycles are performed, the first level of TDS of the flow of liquid received and frozen at the ice mold 124 is generally less than the second level of TDS that accumulates dissolved solids from the first portion. As such, the method 1000 may include at 1022 accumulating dissolved solids from the first portion of the flow of liquid at the second portion of the flow of liquid.

During, or after, the icemaking cycle described with 1010 and 1020, or furthermore with 1022, the method 1000 includes at 1030 providing a supply of liquid from the liquid supply conduit to the reservoir (e.g., from the liquid supply conduit 130 to the reservoir 128) after dispensing the flow of liquid toward the ice mold. Step 1030 may be performed substantially similarly as step 1005. As such, the supply of liquid has a baseline TDS. An initial icemaking cycle (e.g., steps 1010 and 1020) may include the first portion of the flow of liquid having a first level of TDS substantially similar to the baseline TDS. As TDS accumulate at the second portion of the flow of liquid into the reservoir (e.g., reservoir 128), the TDS at the body of liquid increases. Accordingly, the TDS of the first portion of the flow of liquid from the body of liquid at the reservoir increases, and the TDS of the second portion increases further above the TDS of the first portion.

In an exemplary embodiment, a baseline TDS at the body of liquid at the start of an initial or first icemaking cycle is approximately 100 ppm. After completing the first icemaking cycle, the TDS at the body of liquid at the reservoir 128 is approximately 200 ppm. Step 1030 provides the supply of liquid, having the baseline TDS, to the body of liquid remaining at the reservoir 128. Step 1030 may accordingly include diluting the body of liquid at the reservoir with the supply of liquid from the liquid supply conduit to decrease the level of TDS at the body of liquid at the reservoir. Referring to the exemplary embodiment, after completing step 1030, the TDS at the body of liquid may decrease to approximately 150 ppm. A second icemaking cycle may be performed after the first icemaking cycle, in which the starting TDS at the body of liquid and the first portion of the flow of liquid is approximately 150 ppm. After completing the second icemaking cycle, the TDS at the body of liquid at the reservoir 128 is approximately 300 ppm. Step 1030 provides the supply of liquid and accordingly dilutes the TDS to a lesser amount (e.g., from 300 ppm to 200 ppm).

Accordingly, embodiments of the method 1000 may include at 1024 increasing the dissolved solids at the body of liquid at the reservoir by providing the second portion of the flow of liquid to the reservoir, such as in step 1020 or 1022. The method 1000 may include at 1032 decreasing the dissolved solids at the body of liquid by providing the supply of liquid to the reservoir, such as in step 1030.

The method 1000 at 1040 draining the body of liquid from the reservoir (e.g., first reservoir 128) to a second reservoir (e.g., second reservoir 138) when the body of liquid exceeds a threshold of total dissolved solids. In various embodiments, the threshold of total dissolved solids is between 5 times to 10 times an amount of dissolved solids of the supply of liquid provided to the reservoir 128, such as the baseline level of TDS. In an exemplary embodiment, the threshold TDS may be approximately 800 ppm. Several iterations of icemaking cycles may be performed in which each subsequent starting TDS level increases over the previous TDS level. An initial or first icemaking cycle may start at approximately 100 ppm at step 1010, increase to approximately 200 ppm at step 1020, dilute to between 100 ppm and 200 ppm at step 1030 and provide the starting TDS level for the next icemaking cycle. In certain embodiments, after several iterations of icemaking cycles the starting TDS level is at or exceeds the threshold TDS level.

In certain embodiments, the method 1000 includes at 1038 determining the TDS at the body of liquid at the reservoir (e.g., reservoir 128). Determining the TDS may include detecting, calculating, obtaining, or otherwise detecting the TDS level at the body of liquid. Certain embodiments may configure the liquid level sensor 134 to determine the TDS level. In other embodiments, determining the TDS level may be a function of the baseline TDS, a quantity of icemaking cycles, the threshold TDS limit, and an indication of when the body of liquid was previously drained or otherwise replaced. Determining the TDS level may correspond to a predetermined quantity of icemaking cycles until which the body of liquid at the reservoir is at or above the threshold TDS limit.

In a particular embodiment, the method 1000 includes at 1040 draining at least a portion of the body of liquid from the first reservoir 128 to the second reservoir 138 after determining the TDS level at the body of liquid exceeds the threshold TDS limit. Draining the body of liquid may include actuating the valve assembly 156 such as described herein to allow the liquid to flow from the first reservoir 128 to the second reservoir 138.

In certain embodiments, the method 1000 further includes at 1042 evaporating the body of liquid at the second reservoir (e.g., an evaporation tank). Evaporating the body of liquid at the second reservoir 138 may be performed by positioning a heated portion of the condenser, depicted via 176*a*, in thermal communication with the body of liquid at the second reservoir 138. Over time, the reservoir may collect solids left behind as the liquid evaporates. In some embodiments, the second reservoir 138 may be configured to be disposable and replaceable. In certain embodiments, the second reservoir 138 may be formed from a polyethylene terephthalate (PET), a recycled PET (RPET), or other appropriate material.

In still certain embodiments, the reservoir may be treated or integrated with an antimicrobial, an antifungal, an antiviral, or other compound to inhibit bacterial, mold, or viral growth at the body of liquid. The treatment may include chlorine, Microban® or other appropriate solutions. Still certain embodiments may include treating the liquid with an ultraviolet light.

The method 1000 may include at 1044 condensing the evaporated liquid and at 1046 providing the condensate liquid to the first reservoir 128. The icemaking appliance 10 may provide the condensate liquid back to the first reservoir 128 through a second circulation conduit 147 providing fluid communication from the second reservoir 138 to the first reservoir 128. The condensate liquid has a lower TDS than the liquid provided from the first reservoir 128 to the second reservoir 138. The condensate liquid may then be used in the body of liquid, such as described at steps 1010 and 1020.

Embodiments of the appliance 10 and method 1000 provided herein allow for production of clear ice without necessitating draining water to a wastewater drain. Embodiments provided herein allow for recycling water from a first reservoir to a second reservoir and having dissolved solids removed from the high-TDS water before being recycled back to the first reservoir.

Certain embodiments of the appliance 10 and method 1000 provided herein may include approximately doubling an end-of-cycle TDS level versus a start-of-cycle TDS level. For example, a starting TDS of 100 ppm at the body of liquid may end the cycle with 200 ppm at the body of liquid. Still certain embodiments may include diluting the end-of-cycle TDS level to approximately halfway or between the start-of-cycle TDS level (e.g., 100 ppm) and the end-of-cycle TDS level (e.g., 200 ppm), such as to provide a start-of-second cycle TDS level (e.g., 150 ppm). The cycles may iterate until the threshold level of TDS is met or exceeded (e.g., 700 ppm, or 800 ppm, or 1000 ppm, etc.).

In certain embodiments having a baseline TDS of approximately 100 ppm, the appliance 10 and method 1000 may produce approximately six pounds of clear ice for every pound of water drained from the first reservoir 128. In another embodiment having a baseline TDS of approximately 150 ppm, the appliance 10 and method 1000 may produce approximately 3.5 pounds of clear ice for every pound of water drained from the first reservoir 128.

Particular embodiments of the method 1000 include at 1050 reducing a rate of icemaking as the TDS at the body of liquid increases. Reducing the rate of icemaking as the TDS increases may allow for matching evaporating time, liquid recycling or treatment, or rate of consumption by a user.

Figure 6:
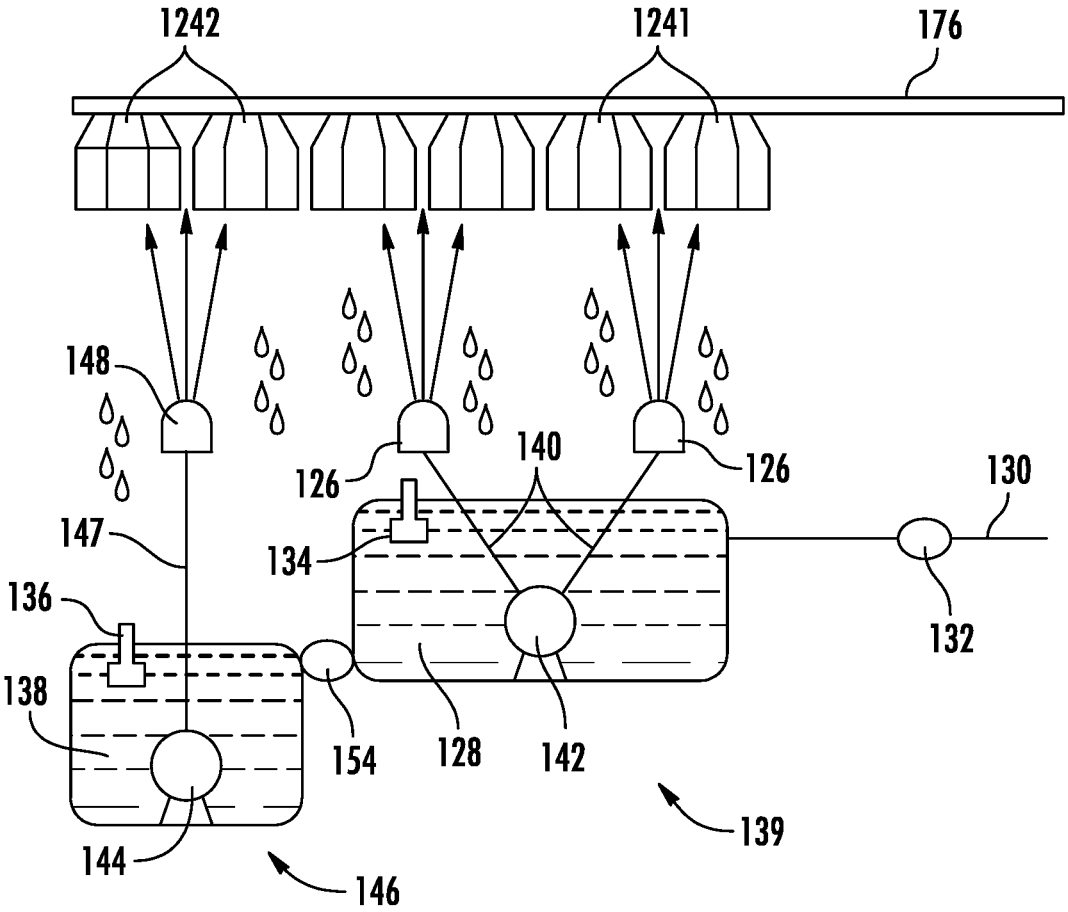
FIG. 6 provides a side schematic view of a plurality of ice molds and first and second reservoirs according to the exemplary icemaker appliance of FIG. 1.

Referring briefly to FIG. 6, the appliance 10 may be configured substantially as provided with regard to FIGS. 1-5. In FIG. 6, the appliance 10 may include a second circulation system 146. Second circulation system 146 may be provided in second reservoir 138. For instance, second circulation system 146 may include a second pump 144, a second circulation conduit 147, and a second nozzle 148. Second circulation system 146 may operate along the same principles as first circulation system 139. For instance, second pump 144 may pump liquid from second reservoir 138 through second conduit 147 toward second nozzle 148. However, second nozzle 148 may direct liquid toward a plurality of second ice molds 1242 as opposed to a plurality of first ice molds 1421. In some embodiments, a plurality of second nozzles 148 may be provided. Each of the plurality of second nozzles 148 may be connected to second pump 144 independently (e.g., each second nozzle 148 having a dedicated second circulation conduit 147). Additionally or alternatively, each of the plurality of second nozzles 148 may be connected to the second pump 144 via a joint circulation conduit.

In some embodiments, first reservoir 128, first ice mold 1241, and first circulation system 139 may collectively be referred to as a first icemaker. Similarly, second reservoir 138, second ice mold 1242, and second circulation system 146 may collectively be referred to as a second icemaker. As will be described in more detail below, second icemaker may not include second circulation system 146.

A second liquid level sensor 136 may be provided in second reservoir 138. Generally, the second liquid level sensor 136 may sense a level of liquid contained within second reservoir 138. In some embodiments, second liquid level sensor 136 is in operable communication with controller 190. For instance, second liquid level sensor 136 may communicate with the controller 190 via one or more signals. In certain embodiments, second liquid level sensor 136 includes a predetermined threshold level (e.g., to indicate the need for additional liquid to second reservoir 138). In particular, second liquid level sensor 136 may detect if or when the liquid second reservoir 138 is below the predetermined threshold level. Optionally, second liquid level sensor 136 may be a two-position sensor. In other words, second liquid level sensor 136 may either be "on" or "off," depending on a level of liquid. For example, when the liquid level is below the predetermined threshold level, second liquid level sensor 136 is "off," meaning it does not send a signal to second pump 144 via controller 190 to pump liquid from second reservoir 138 through second circulation conduit 147 toward second nozzle 148. For another example, when the liquid level is above the predetermined threshold, second liquid level sensor 136 is "on," meaning it sends a signal to second pump 144 via controller 190 to operate second pump 144 to pump liquid through second circulation conduit 147 toward second nozzle 148. It should be understood that second liquid level sensor 136 may be any suitable sensor capable of determining a level of liquid within second reservoir 138, and the disclosure is not limited to those examples provided herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An icemaker appliance, comprising:

a cabinet forming an ice storage compartment;

a reservoir provided within the ice storage compartment an evaporation tank in fluid communication with the reservoir;

a liquid supply conduit configured to supply liquid to the reservoir;

an ice mold configured to freeze liquid at the ice mold;

a nozzle configured to dispense the liquid from the reservoir to the ice mold; and a controller configured to execute instructions that perform operations, the operations comprising:

dispensing, from a body of liquid at the reservoir, a flow of liquid toward the ice mold;

freezing, at the ice mold, a first portion of the flow of liquid received from dispensing the flow of liquid to the ice mold;

providing, to the reservoir, a second portion of the flow of liquid dispensed toward the ice mold; and providing, from the liquid supply conduit to the reservoir, a supply of liquid after dispensing the flow of liquid toward the ice mold;

evaporating the body of liquid at the evaporation tank;

condensing the evaporated liquid; and providing the condensate liquid to the reservoir.

2. The icemaker appliance of claim 1, wherein the first portion of the flow of liquid has a first level of total dissolved solids less than the second portion of the flow of liquid having a second level of total dissolved solids.

3. The icemaker appliance of claim 1, the operations comprising:

accumulating dissolved solids from the first portion of the flow of liquid at the second portion of the flow of liquid.

4. The icemaker appliance of claim 3, the operations comprising:

increasing the dissolved solids at the body of liquid at the reservoir by providing the second portion of the flow of liquid to the reservoir.

5. The icemaker appliance of claim 4, the operations comprising:

decreasing the dissolved solids at the body of liquid by providing the supply of liquid to the reservoir.

6. The icemaker appliance of claim 1, the operations comprising:

draining the body of liquid from the reservoir to the evaporation tank when the body of liquid exceeds a threshold of total dissolved solids.

7. The icemaker appliance of claim 6, the operations comprising:

determining the total dissolved solids at the body of liquid at the reservoir.

8. The icemaker appliance of claim 6, wherein the threshold of total dissolved solids is between 5 times to 10 times an amount of dissolved solids of the supply of liquid provided to the reservoir.

9. The icemaker appliance of claim 1, the appliance comprising:

a condenser in thermal communication with the evaporation tank, wherein evaporating the body of liquid at the evaporation tank comprises providing the body of liquid in thermal communication with a condenser.

10. The icemaker appliance of claim 1, wherein dispensing the flow of liquid toward the ice mold comprises spraying the flow of liquid through the nozzle toward the ice mold.

11. The icemaker appliance of claim 1, wherein the first portion of the flow of liquid frozen at the ice mold is approximately 10% or less of the flow of liquid dispensed toward the ice mold, and wherein the second portion of the flow of liquid is a remainder of the flow of liquid dispensed toward the ice mold.

12. The icemaker appliance of claim 1, wherein the controller is configured to iterate dispensing the flow of liquid, freezing the first portion of the flow of liquid, providing the second portion of the flow of liquid, and providing the supply of liquid until a threshold of total dissolved solids at the body of liquid is exceeded.

13. A method for producing ice, the method comprising:

dispensing, from a body of liquid at a reservoir, a flow of liquid toward an ice mold;

freezing, at the ice mold, a first portion of the flow of liquid received from dispensing the flow of liquid to the ice mold;

providing, to the reservoir, a second portion of the flow of liquid dispensed toward the ice mold; and providing, from a liquid supply conduit to the reservoir, a supply of liquid after dispensing the flow of liquid toward the ice mold;

evaporating the body of liquid at an evaporation tank;

condensing the evaporated liquid; and providing the condensate liquid to the reservoir fluid communication with the evaporation tank.

14. The method of claim 13, wherein the first portion of the flow of liquid has a first level of total dissolved solids less than the second portion of the flow of liquid having a second level of total dissolved solids.

15. The method of claim 13, the method comprising:

iterating dispensing the flow of liquid, freezing the first portion of the flow of liquid, providing the second portion of the flow of liquid, and providing the supply of liquid until a threshold of total dissolved solids at the body of liquid is exceeded.

16. The method of claim 15, wherein the threshold of total dissolved solids at the body of liquid is between approximately 650 ppm and approximately 1000 ppm.

17. The method of claim 13, the method comprising:

increasing the dissolved solids at the body of liquid at the reservoir by accumulating dissolved solids from the first portion of the flow of liquid at the second portion of the flow of liquid when providing the second portion of the flow of liquid to the reservoir; and decreasing the dissolved solids at the body of liquid by providing the supply of liquid to the reservoir.

* * * * *